US011839291B2

(12) United States Patent
Basireddy et al.

(10) Patent No.: US 11,839,291 B2
(45) Date of Patent: Dec. 12, 2023

(54) ORAL CARE IMPLEMENT

(71) Applicant: AB Innovations, LLC, Baton Rouge, LA (US)

(72) Inventors: Akshay Basireddy, Baton Rouge, LA (US); Alaina Marcomb Reed, Watson, LA (US); Benjamin Ebrahim, New Orleans, LA (US); James Andrew Stapp, Jr., Metairie, LA (US)

(73) Assignee: AB INNOVATIONS, LLC, Baton Rouge, LA (US)

( * ) Notice: Subject to any disclaimer, the term of this patent is extended or adjusted under 35 U.S.C. 154(b) by 0 days.

(21) Appl. No.: 17/539,429

(22) Filed: Dec. 1, 2021

(65) Prior Publication Data

US 2023/0165364 A1 Jun. 1, 2023

(51) Int. Cl.

| | |
|---|---|
| ***A46B 11/00*** | (2006.01) |
| ***A46B 11/06*** | (2006.01) |
| ***A46B 9/04*** | (2006.01) |

(52) U.S. Cl.

CPC ..... *A46B 11/0086* (2013.01); *A46B 9/04* (2013.01); *A46B 11/002* (2013.01); *A46B 11/06* (2013.01); *A46B 11/0062* (2013.01); *A46B 2200/1066* (2013.01)

(58) Field of Classification Search

CPC ..... A46B 11/0086; A46B 11/06; A46B 9/04; A46B 11/002; A46B 2200/1066; A46B 11/00; A46B 11/0062

USPC ..... 401/268, 270, 280, 281, 282, 289

See application file for complete search history.

(56) References Cited

U.S. PATENT DOCUMENTS

| | | | | |
|---|---|---|---|---|
| 2,766,472 | A * | 10/1956 | Durrett | A46B 11/0079 401/281 |
| 4,199,270 | A * | 4/1980 | Tomasini | A46B 15/00 401/277 |
| 4,291,995 | A | 9/1981 | Dikoff | |
| 4,580,588 | A | 4/1986 | Swope, Jr. | |
| 4,615,635 | A | 10/1986 | Kim | |
| 5,096,321 | A * | 3/1992 | Mountain | A46B 11/0058 401/176 |
| 5,309,590 | A | 5/1994 | Giuliani et al. | |
| 5,393,153 | A | 2/1995 | Bouthillier et al. | |
| 9,339,103 | B1 | 5/2016 | Watters | |
| 2003/0056307 | A1 | 3/2003 | Tybinkowski et al. | |
| 2003/0095828 | A1 | 5/2003 | Hofstedt | |
| 2004/0057773 | A1 | 3/2004 | Gray | |
| 2005/0058501 | A1 | 3/2005 | Evans | |
| 2005/0286967 | A1 * | 12/2005 | Blauzdys | A46B 5/0095 401/184 |
| 2007/0269260 | A1 | 11/2007 | Kirby | |
| 2010/0080646 | A1 | 4/2010 | Manukian | |

FOREIGN PATENT DOCUMENTS

| | | | |
|---|---|---|---|
| WO | 2005072559 | A1 | 8/2005 |
| WO | 2010023493 | A1 | 3/2010 |

OTHER PUBLICATIONS

Watters, Susan; "Toothbrush With Dispensing Toothpaste"; available at https://www.youtube.com/watch?v=arDKNRNefp0; You Tube Video, last accessed Dec. 1, 2021.

* cited by examiner

*Primary Examiner* — David J Walczak

(57) ABSTRACT

One or more oral care implements and one or more related methods include an outer member, an inner member positioned within at least a portion of the outer member, and a cleaning element extending from the outer member.

15 Claims, 16 Drawing Sheets

ORAL CARE IMPLEMENT

FIELD

The present disclosure relates to oral care implements, such as toothbrushes, and related methods, and more specifically to an oral care implement configured for placing in fluid communication with a reservoir containing an oral care fluid.

BRIEF BACKGROUND

This section introduces information that may be related to or provide context for some aspects of the techniques described herein and/or claimed below. This information is background facilitating a better understanding of that which is disclosed herein. Such background may include a discussion of "related" art. That such art is related in no way implies that it is also "prior" art. The related art may or may not be prior art. The discussion is to be read in this light, and not as admissions of prior art.

Various types of disposable, limited use, or portable oral care implements, such as toothbrushes, are known in the art. For example, some toothbrushes provide toothpaste within the toothbrush itself through an integrated reservoir for distribution through the toothbrush and around the bristles. But, this approach can be less economical due to the added manufacturing costs of toothbrushes with an integrated reservoir. In addition, due to improper sealing, the toothpaste in some toothbrushes with an integrated reservoir can become dry, hard and/or stale. Further, some toothbrushes may not be designed to be positioned from a closed state to an open state and/or from an open state to a closed state so as to control the flow of an oral care fluid through the oral care implement.

Thus, there is a need for new and improved oral care implements and methods that minimize or reduce the impact from the above and other limitations.

NON-LIMITING SUMMARY

In general, the present disclosure provides one or more oral care implements and related methods.

In an aspect, an oral care implement is provided. The oral care implement includes an elongated outer member comprising a head defining at least one opening, a base, and at least one cavity formed by the outer member and extending from the head to the base; an elongated inner member comprising a first end portion defining an aperture configured for placing in fluid communication with the opening of the head, a second end portion and at least one channel formed by the inner member and extending from the first end portion to the second end portion; and a cleaning element extending from the head. The oral care implement is configured for placing in fluid communication with a reservoir containing the oral care fluid. At least a portion of the elongated inner member is sized and configured to be positioned within at least a portion of the elongated outer member. At least a portion of the elongated inner member is rotatable within at least a portion of the elongated outer member from a closed state to an open state and from an open state to a closed state so as to control the flow of an oral care fluid through the oral care implement.

One or more aspects include the oral care implement of the preceding paragraph in which in the closed state the aperture is not in fluid communication with the opening thereby preventing the flow of the oral care fluid through the oral care implement.

One or more aspects include the oral care implement of any preceding paragraph in which in the open state the aperture is in fluid communication with the opening thereby permitting the flow of the oral care fluid through the oral care implement.

One or more aspects include the oral care implement of any preceding paragraph in which the base of the elongated outer member interfaces with the second end portion of the elongated inner member to form a lock configured to place the oral care implement is in the closed state or the open state.

One or more aspects include the oral care implement of any preceding paragraph in which the elongated inner member further comprises one or more protrusions configured to interface with one or more corresponding tabs of the elongated outer member to prevent rotation of the elongated outer member beyond a predetermined point relative to the elongated inner member.

One or more aspects include the oral care implement of any preceding paragraph in which at least one flipper extends from the elongated outer member and is sized and configured to bend beyond at least one of the protrusions of the elongated inner member.

One or more aspects include the oral care implement of any preceding paragraph in which the oral care implement further comprises at least one flipper sized and configured to bend beyond at least one of the tabs of the elongated outer member, at least one of the protrusions of the elongated outer member, or both.

One or more aspects include the oral care implement of any preceding paragraph in which the portion of the elongated outer member defining the opening tapers at a cross-sectional angle extending along the length of the opening.

One or more aspects include the oral care implement of any preceding paragraph in which the portion of the elongated outer member defining the opening is frustoconical.

One or more aspects include the oral care implement of any preceding paragraph in which the oral care implement further comprises a sealing element positioned at or within the base of the elongated inner member so as to prevent or reduce drying of the oral care fluid.

One or more aspects include the oral care implement of any preceding paragraph in which the oral care implement further comprises an adapter for placing in fluid communication with a reservoir containing an oral care fluid and a sealing element positioned within the adapter so as to prevent or reduce drying of the oral care fluid.

One or more aspects include the oral care implement of any preceding paragraph in which the cleaning element comprises a plurality of teeth cleaning elements.

One or more aspects include the oral care implement of any preceding paragraph in which the opening is sized and positioned so as to permit substantially even distribution of the oral care fluid on an outer surface of the head and the cleaning element.

One or more aspects include the oral care implement of any preceding paragraph in which the oral care fluid flows through a path comprising at least one channel formed by the elongated inner member in fluid communication with at least one opening defined by a head of the elongated outer member.

One or more aspects include the oral care implement of the preceding paragraph in which when an external pressure is applied to the reservoir in the range of 1.4 psig to about 3.8 psig, the oral care fluid flows through the path at a flow rate in the range of about 0.0065 $in^3$/sec to about 0.0102 $in^3$/sec.

In another aspect, a method is provided. The method includes rotating at least a portion of an elongated inner member of an oral care implement within at least a portion of an elongated outer member of the oral care implement so as to control the flow of an oral care fluid from a reservoir through the oral care implement. In a closed state an aperture formed by a first end portion of the elongated inner member is not in fluid communication with an opening formed by a head of the elongated outer member thereby preventing the flow of the oral care fluid through the oral care implement. In an open state the aperture is in fluid communication with the opening thereby permitting the flow of the oral care fluid through the oral care implement.

One or more aspects include the method of the preceding paragraph in which the oral care fluid flows through a path comprising at least one channel formed by the elongated inner member in fluid communication with at least one opening defined by a head of the elongated outer member.

One or more aspects include the method of any preceding paragraph in which when an external pressure is applied to the reservoir in the range of 1.4 psig to about 3.8 psig, the oral care fluid flows through the path at a flow rate in the range of about 0.0065 $in^3$/sec to about 0.0102 $in^3$/sec.

One or more aspects include the method of any preceding paragraph in which the elongated inner member further comprises one or more protrusions configured to interface with corresponding tabs extending from the elongated outer member to prevent rotation of the elongated outer member beyond a predetermined point relative to the elongated inner member.

One or more aspects include the method of any preceding paragraph in which the oral care implement further comprises at least one flipper extending sized and configured to bend beyond at least one of the protrusions of the elongated inner member, at least one of the protrusions of the elongate outer member, or both.

While multiple embodiments are disclosed, still others will become apparent to those skilled in the art from the following detailed description. As will be apparent, certain embodiments, as disclosed herein, are capable of modifications in various obvious aspects, all without departing from the spirit and scope of the claims as presented herein. Accordingly, the drawings and detailed description are to be regarded as illustrative in nature and not restrictive.

BRIEF DESCRIPTION OF THE DRAWINGS

For a detailed description of the preferred embodiments of the disclosed embodiments, reference will now be made to the accompanying drawings in which.

Figure 1A:
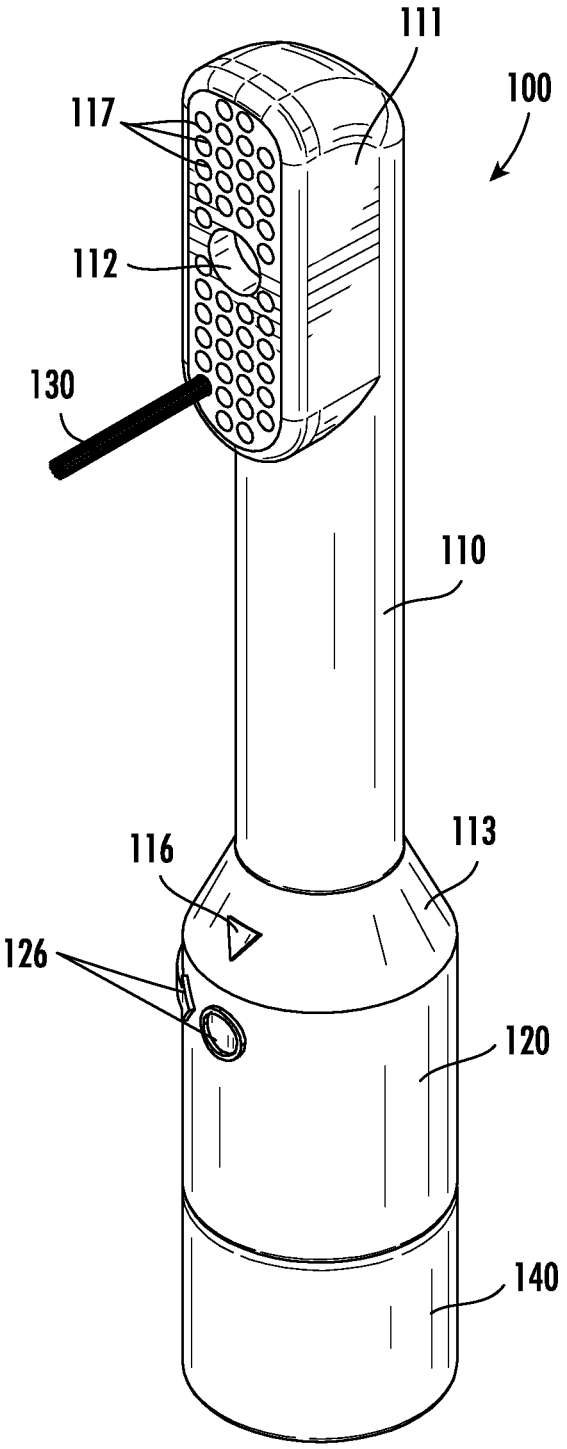
FIG. 1A illustrates a perspective view of an oral care implement in accordance with certain aspects of the subject matter described herein.

While the claimed subject matter is susceptible to various modifications and alternative forms, the drawing(s) illustrate specific embodiments herein described in detail by way of example. It should be understood, however, that the description herein of specific embodiments is not intended to limit the claimed subject matter to the particular forms disclosed, but on the contrary, the intention is to cover all modifications, equivalents, and alternatives falling within the spirit and scope as defined by the appended claims.

Definitions

To more clearly define the terms used in this disclosure, the following definitions are provided. Unless otherwise indicated, the following definitions are applicable to this disclosure. To the extent that any definition or usage provided by any document incorporated here by reference conflicts with the definition or usage provided herein, the definition or usage provided in this disclosure controls.

In this disclosure, features of the subject matter are described such that, within particular aspects, a combination of different features can be envisioned. For each and every aspect and each and every feature disclosed herein, all combinations that do not detrimentally affect the designs, implements, apparatuses, systems, processes, or methods described herein are contemplated with or without explicit description of the particular combination. Additionally, unless explicitly recited otherwise, any aspect or feature disclosed herein can be combined to describe inventive designs, implements, apparatuses, systems, processes, or methods consistent with the present disclosure.

In this disclosure, while implements and methods are often described in terms of "comprising" various components or steps, the foregoing can also "consist essentially of" or "consist of" the various components or steps, unless stated otherwise. For example, an oral care implement consistent with aspects of the disclosed subject matter can comprise; alternatively, can consist essentially of; or alternatively, can consist of the various components, unless stated otherwise. As another example, a method consistent with aspects of the disclosed subject matter can comprise; alternatively, can consist essentially of; or alternatively, can consist of the various steps, unless stated otherwise.

The terms "a," "an," and "the" are intended to include plural alternatives, e.g., at least one, one or more, and one or more than one, unless otherwise specified.

The term "about" means that amounts, sizes, formulations, parameters, and other quantities and characteristics are not and need not be exact, but may be approximate including being larger or smaller, as desired, reflecting tolerances, conversion factors, rounding off, measurement errors, and the like, and other factors known to those of skill in the art. In general, an amount, size, formulation, parameter or other quantity or characteristic is "about" or "approximate" whether or not expressly stated to be such. Whether or not modified by the term "about," the claims include equivalents to the quantities.

Various numerical ranges are disclosed herein. When a range of any type is disclosed or claimed herein (e.g., "ranging from . . . ", "in the range of from . . . ", "in a range of from") the intent is to disclose or claim individually each possible number that such a range could reasonably encompass, including end points of the range as well as any sub-ranges and combinations of sub-ranges encompassed therein, unless otherwise specified. For example, the present disclosure recites that a pressure is in the range of from about 1.4 psig to about 3.8 psig in certain aspects. By a disclosure that the pressure can be in a range from about 1.4 psig to about 3.8 psig, the intent is to recite that the pressure can be any pressure within the range and, for example, can be equal to about 1.4 psig, about 1.5 psig, about 1.6 psig, about 1.7 psig, about 1.8 psig, about 1.9 psig, about 2.0 psig, about 2.1 psig, about 2.2 psig, about 2.3 psig, about 2.4 psig, about 2.5 psig, about 2.6 psig, about 2.7 psig, about 2.8 psig, about 2.9 psig, about 3.0, psig about 3.1 psig, about 3.2 psig, about 3.3 psig, about 3.4 psig, about 3.5 psig, about 3.6 psig, about 3.7 psig, or about 3.8 psig. Additionally, the pressure can be within any range from about 1.4 psig to about 3.8 psig (for example, the pressure can be in a range from about 1.9 psig to 2.9 psig), and this also includes any combination of ranges between about 1.4 psig to about 3.8 psig. Likewise, all other ranges disclosed herein should be interpreted in a manner similar to this example.

Embodiments disclosed herein can provide the components listed as suitable for satisfying a particular feature of the embodiment delimited by the term "or." For example, a particular feature of the disclosed subject matter can be disclosed as follows: Feature X can be A, B, or C. It is also contemplated that for each feature the statement can also be phrased as a listing of alternatives such that the statement "Feature X is A, alternatively B, or alternatively C" is also an embodiment of the present disclosure whether or not the statement is explicitly recited.

All publications and patents mentioned herein are incorporated herein by reference for the purpose of describing and disclosing, for example, the constructs and methodologies that are described in the publications, which can be used in connection with the presently described subject matter.

DETAILED DESCRIPTION

Illustrative aspects of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with device-related and business-related constraints, which will vary from one implementation to another. Moreover, it will be appreciated that such a development effort, even if complex and time-consuming, would be a routine undertaking for those of ordinary skill in the art having the benefit of this disclosure.

The present disclosure is generally directed to one or more oral care implements, and related methods.

A. Oral Care Implement

Figure 1B:
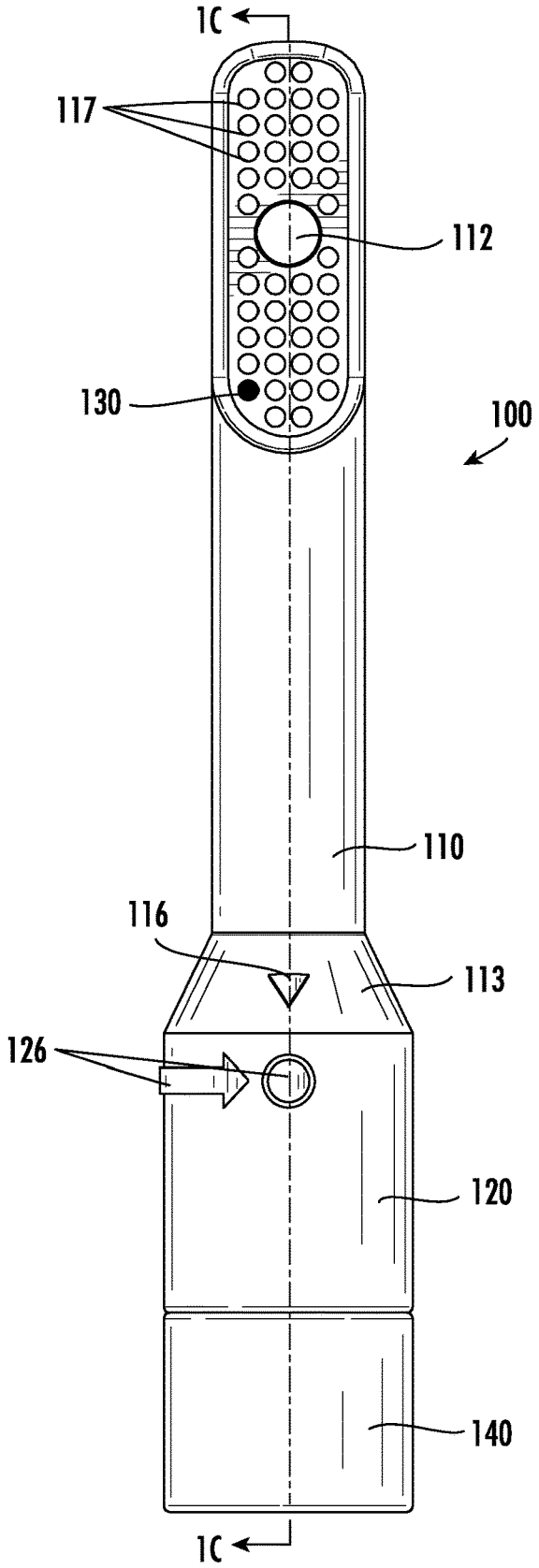
FIG. 1B illustrates a view of the oral care implement shown in FIG. 1A.
Figure 1C:
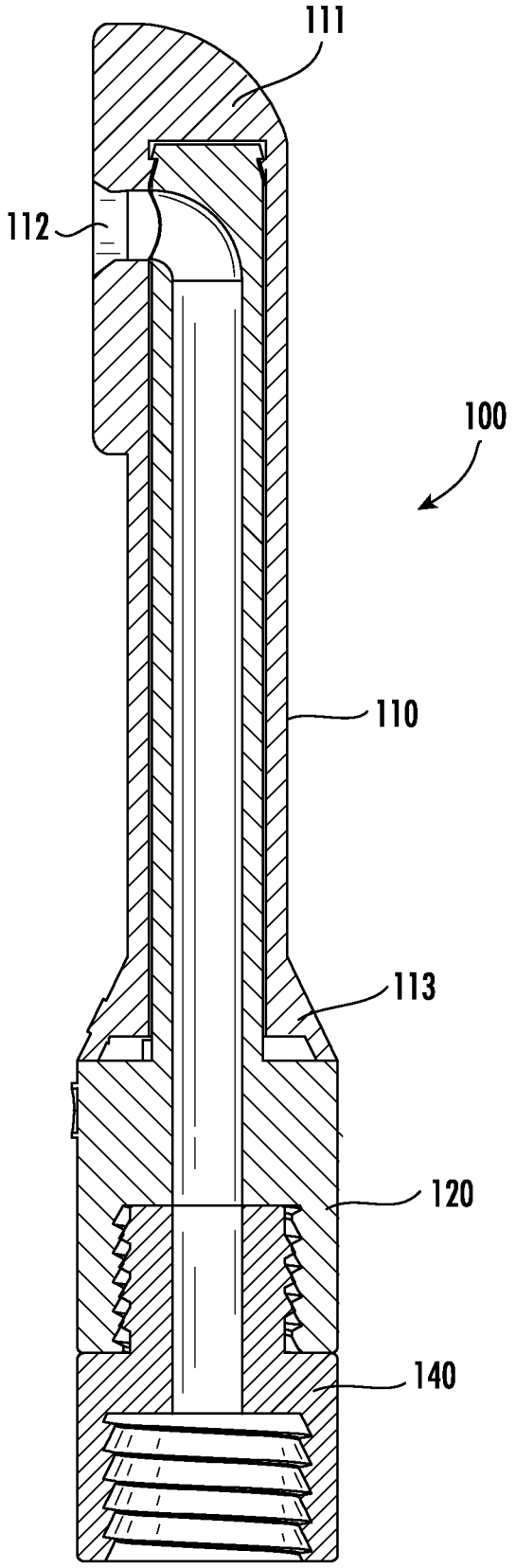
FIG. 1C illustrates a cross-sectional view of the oral care implement shown in FIG. 1B.

FIGS. 1A-1C illustrate an oral care implement 100 in accordance with certain aspects of the disclosed subject matter. The oral care implement 100 comprises a body that comprises an outer member 110, an inner member 120, and a cleaning element 130. The oral care implement 100 is configured for placing in fluid communication with a separate reservoir (e.g., a tube of toothpaste; not shown in Figures) containing oral care fluid such as toothpaste. In an aspect, the oral care implement 100 may optionally further comprise an adapter 140 to permit placement of the oral care implement 100 into fluid communication with a variety of different reservoirs containing oral care fluid.

A1. Outer Member

Figure 2A:
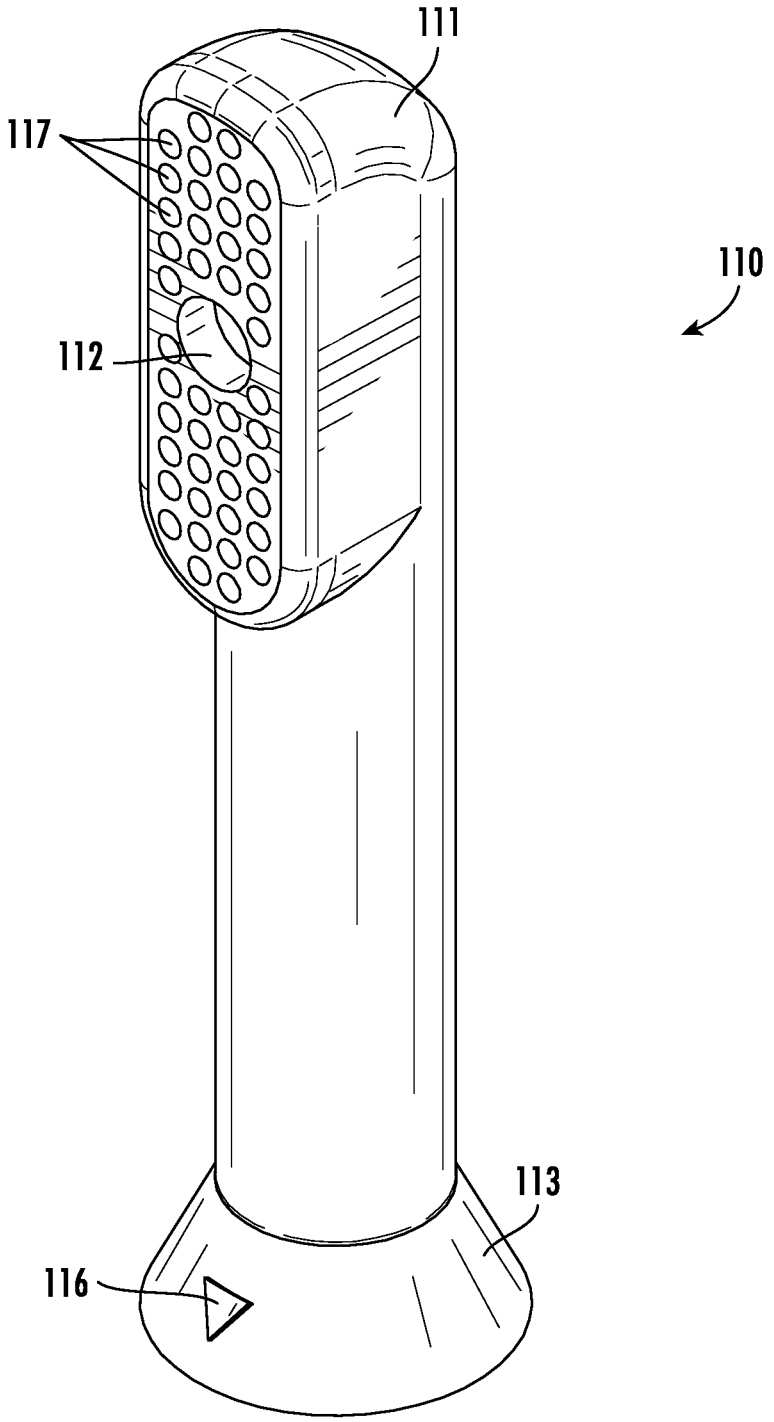
FIG. 2A illustrates a perspective view of the outer member of the oral care implement shown in FIG. 1A.
Figure 2B:
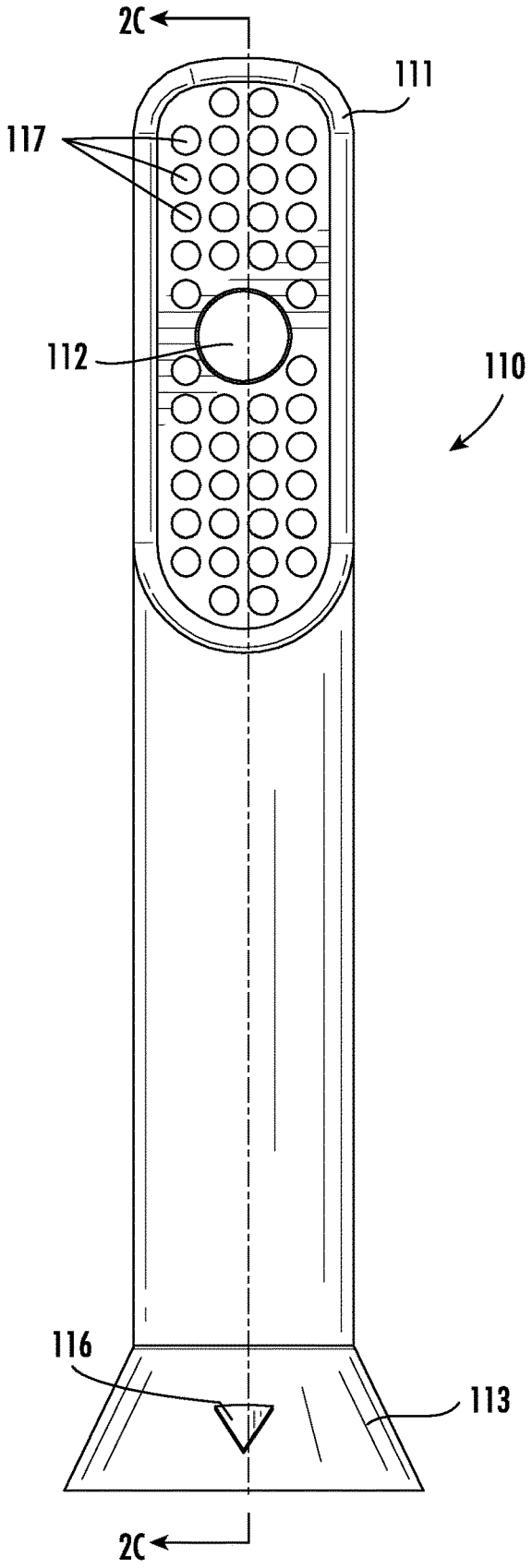
FIG. 2B illustrates a view of the outer member shown in FIG. 2A.
Figure 2C:
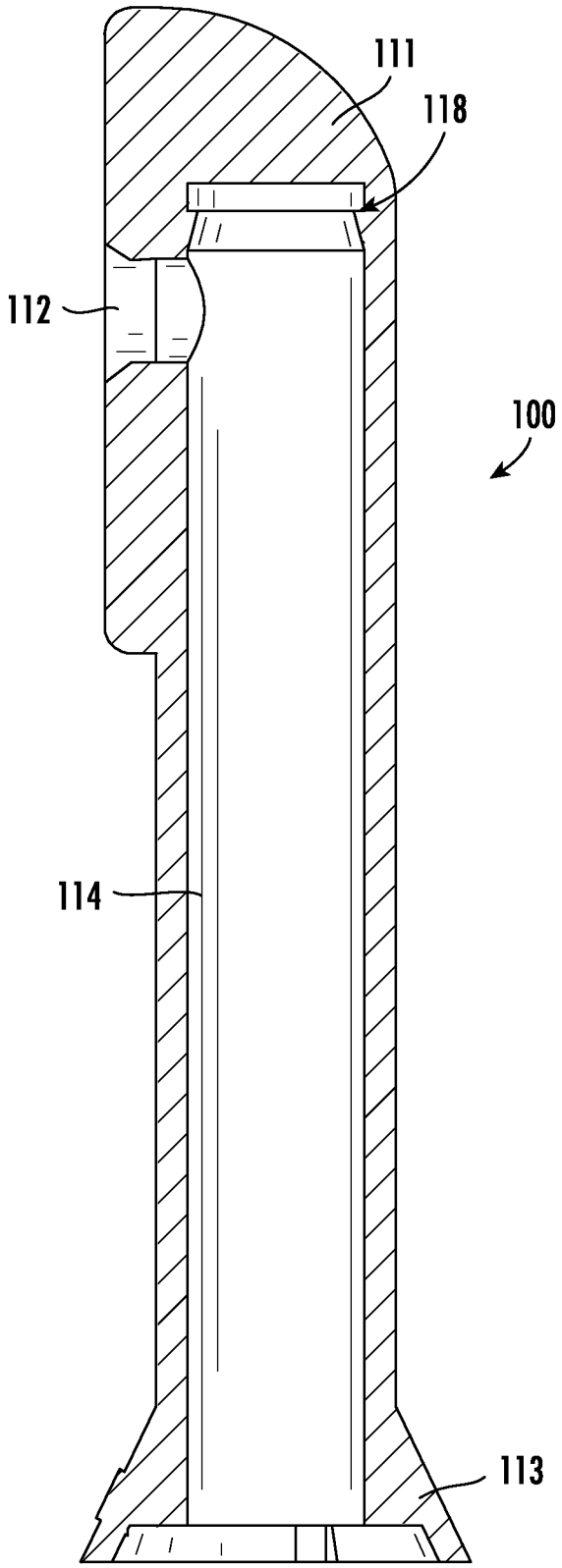
FIG. 2C illustrates a cross-sectional view of the outer member shown in FIG. 2B.

As shown in FIGS. 2A-2E, the outer member 110 comprises a head 111 defining at least one opening 112, a base 113, and at least one cavity 114 formed by the outer member 110 and extending therethrough from the head 111 to the base 113. In an aspect, the outer member 110 can be an elongated member. The opening 112 and the cavity 114 are in fluid communication with each other to enable oral care fluid to flow through the outer member 110. For example, as shown in FIG. 2C, the opening 112 may be substantially perpendicular to the longitudinal axis of the cavity 114. The cavity 114 formed by the outer member 110 may be sized and configured for an axial lock portion 118 of the cavity 114 to interface with a corresponding axial lock groove 127 provided on the inner member 120 so as to securely connect the outer member 110 to the inner member 120.

The head 111 is configured to permit the cleaning element 130 to be secured to the head 111. For example and as shown in FIG. 2A, the outer surface of the head 111 can comprise one or more recesses 117 to allow the cleaning element 130 to be secured to the outer surface of the head 111. In an aspect, the portion of the outer member 110 defining the opening 112 is sized and configured to taper at a cross-sectional angle extending along the length of the opening 112. For example, the portion of the outer member 110 defining the opening 112 can be sized and configured to have a frustoconical shape as illustrated in FIG. 2C.

Figure 2D:
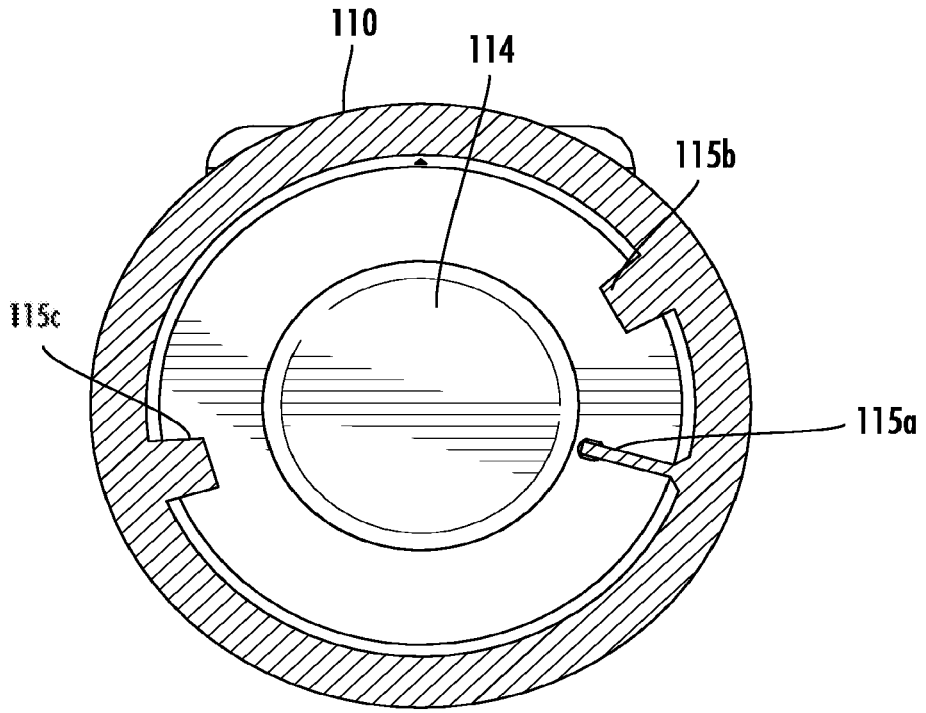
FIG. 2D illustrates a bottom view of the outer member shown in in FIG. 2B.
Figure 2E:
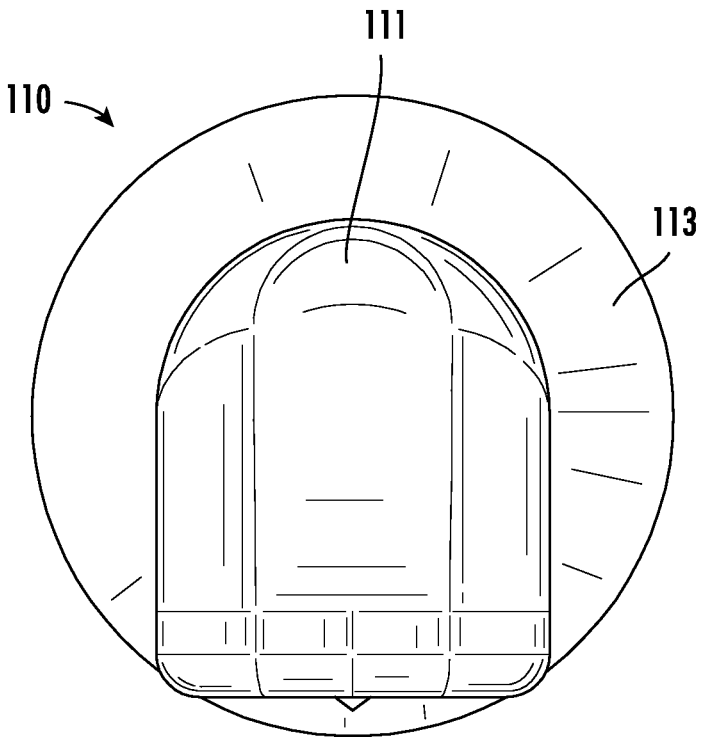
FIG. 2E illustrates a top view of the outer member shown in FIG. 2B.

As shown in FIG. 2D, the base 113 of the outer member 110 comprises one or more tabs 115*a*, 115*b*, 115*c* configured to interface with the inner member 120 to prevent rotation of the outer member 110 beyond a predetermined point relative to the inner member 120. For example and as shown in FIG. 2C and FIG. 2D, the base 113 of the outer member 110 defines at least 3 tabs 115*a*, 115*b*, 115*c*. In an aspect, at least one of the tabs 115*a* may be sized and shaped to be in the form of a flipper. The flipper 115*a* is sized and configured to bend beyond at least one of the protrusions 125*a*, 125*b*, 125*c* of the elongated inner member 120.

The outer member 110 can also comprise an indicator 116 to show if the oral care implement 100 is in a closed state, an open state, or in between the closed state and the open state. For example and as shown in FIG. 2A and FIG. 2B, the outer surface of the outer member 110 can include an arrow or triangle as the indicator 116 that is used in connection with one or more corresponding indicators 126 of the inner member 120 to provide a visual indication the state of the oral care implement 100.

It should be appreciated that the outer member 110 may be constructed from any sufficiently durable and resilient material. Examples of suitable materials for the outer member 110 include a variety of plastics and resins, such as, for example, polypropylene and polyethylene.

A2. Inner Member

With reference to FIGS. 3A-3D, the inner member 120 comprises a first end portion 121, a second end portion 123, and at least one channel 124 formed by the inner member 120 extending therethrough from the first end portion 121 to the second end portion 123. In an aspect, the inner member 120 can be an elongated member and configured for placement within the outer member 110. For example and as illustrated in FIGS. 1A-1C, at least a portion of the elongated inner member 120 may be sized and configured to be positioned within at least a portion of the elongated outer member 110. The first end portion 121 defines at least one aperture 122 configured for placing in fluid communication with the opening 112 of the head 111. The aperture 122 is in fluid communication with the channel 124.

Figure 3A:
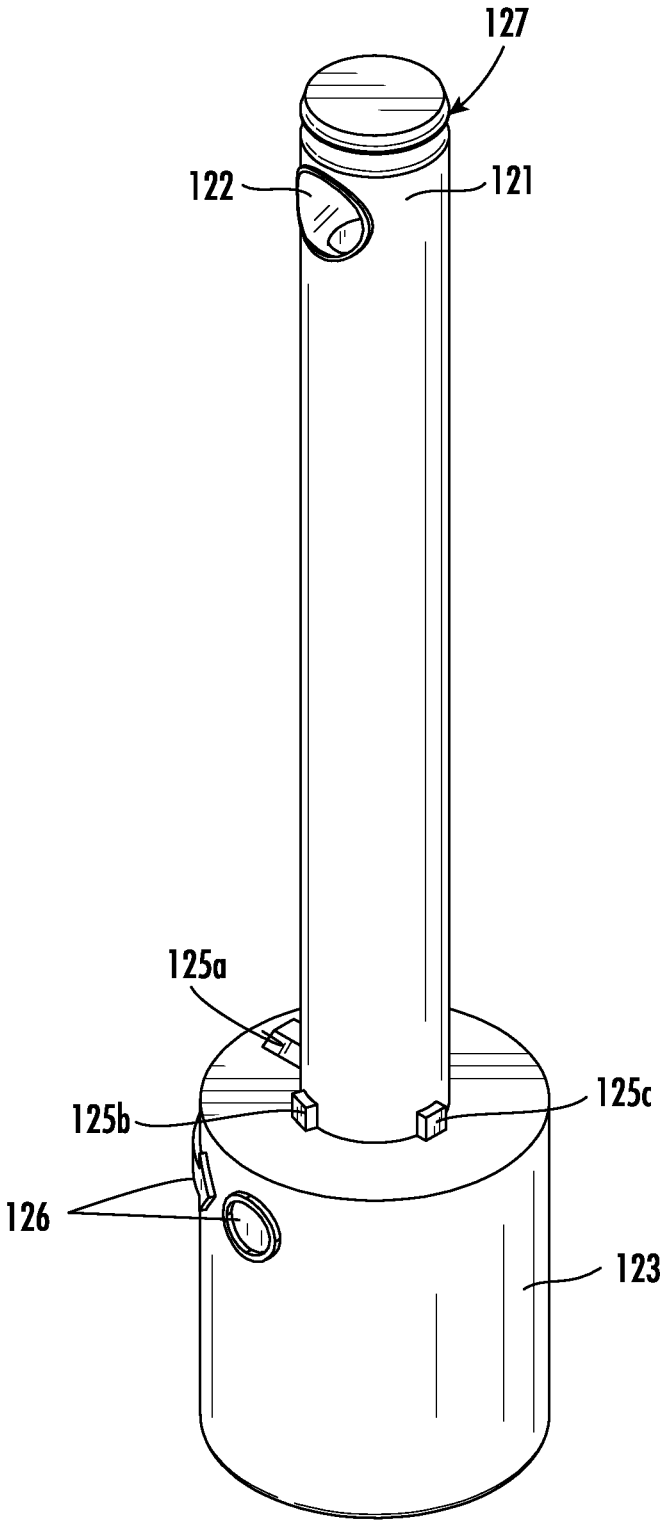
FIG. 3A illustrates a perspective view of the inner member of the oral care implement shown in FIG. 1A.
Figure 3B:
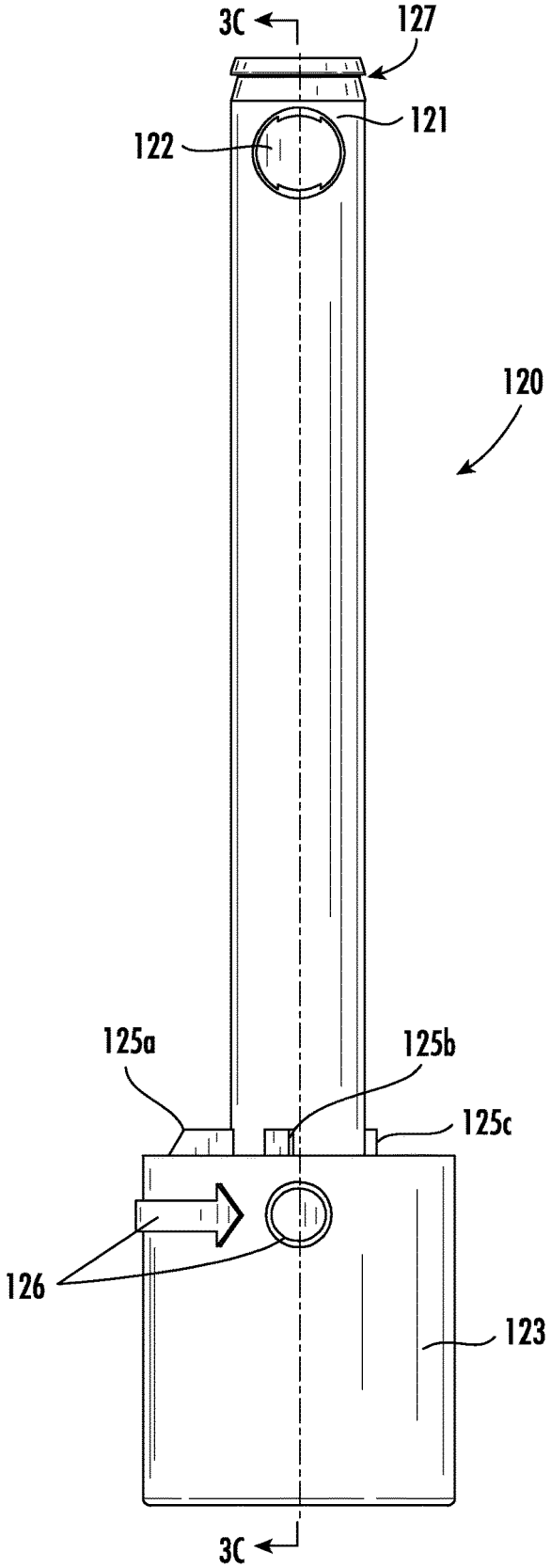
FIG. 3B illustrates a view of the inner member shown in FIG. 3A.
Figure 3C:
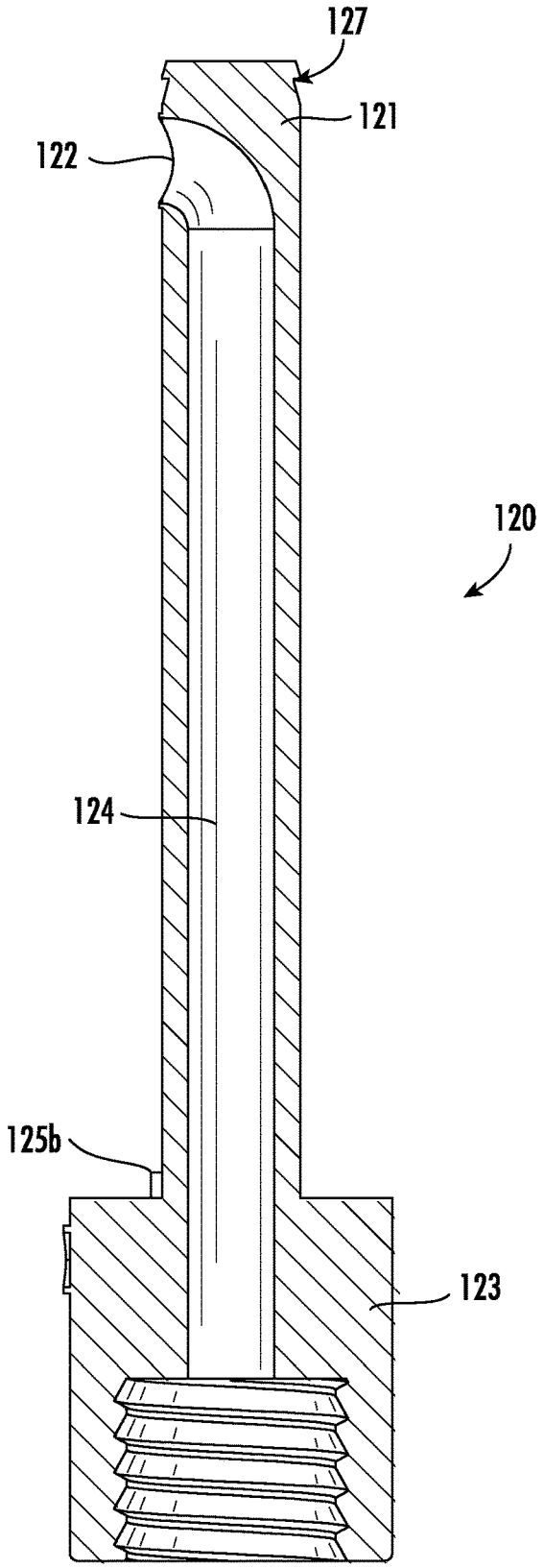
FIG. 3C illustrates a cross-sectional view of the inner member shown in FIG. 3B.
Figure 3D:
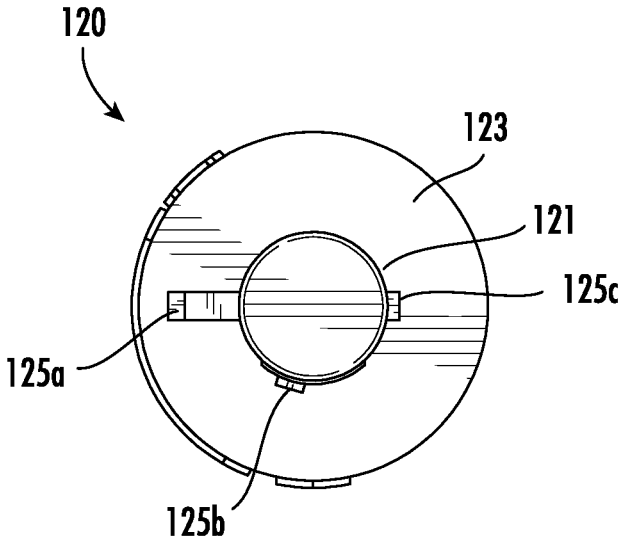
FIG. 3D illustrates a top view of the inner member shown in FIG. 3B.

The first end portion 121 may also comprise an axial lock 127. The axial lock 127 is sized and configured to interface with the axial lock portion 118 of the cavity 114 of the outer member 110 so as to securely connect the outer member 110 and inner member 120. The axial lock 127 may comprise an angled groove that is defined by the first end portion 121 of the inner member 120. The angled groove 127 may extend around the perimeter of the outer surface of first end portion 121. For example and as shown in FIG. 3A and FIG. 3B, the angled groove 127 extends around the circumference of the first end portion 121 of the inner member 120.

In an aspect, the inner member 120 is rotatable within the outer member 110 from the closed state to the open state and from the open state to the closed state. In this manner, it is possible to control the flow of the oral care fluid through the oral care implement 100. For example and as illustrated in FIG. 1A-1C, at least a portion of the elongated inner member 120 fits within and is rotatable within at least a portion of the elongated outer member 110. When the inner member 120 is rotated within the outer member 110 to place the oral care implement 100 in the closed state, the aperture 122 is not in fluid communication with the opening 112 thereby preventing or substantially reducing the flow of the oral care fluid from the separate reservoir through the oral care implement 100 to the head 111. When the inner member 120 is rotated within the outer member 110 to place the oral care implement 100 in the open state, the aperture 122 is in fluid communication with the opening 112 thereby permitting the flow of the oral care fluid from the separate reservoir through the oral care implement 100 to the head 111.

Figure 5:
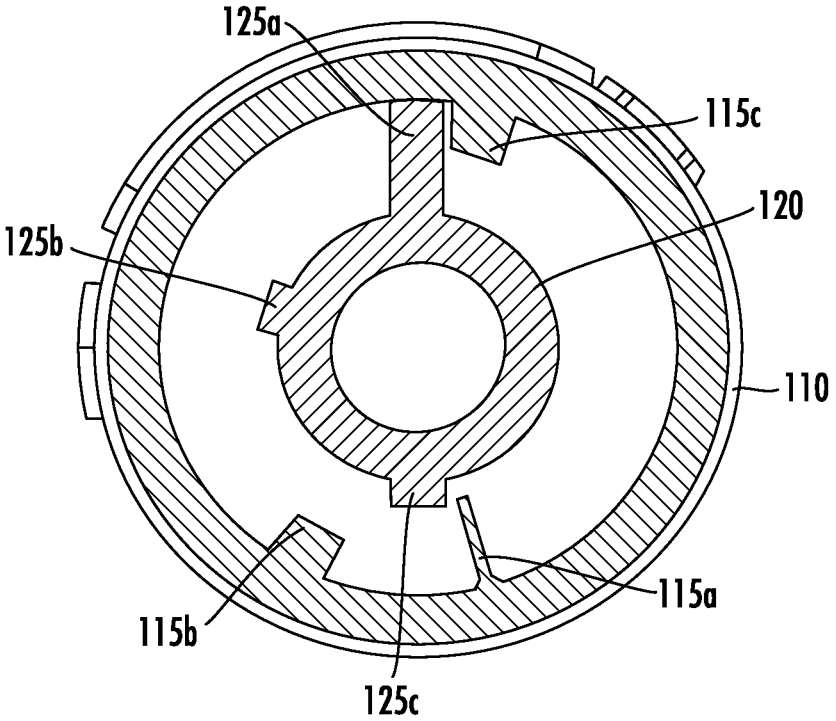
FIG. 5 illustrates a view of the interface between the inner member and outer member in connection with the lock in accordance with certain aspects of the subject matter described herein.

In an aspect, the base 113 of the outer member 110 interfaces with the second end portion 123 of the inner member 120 to form a twist lock configured to place the oral care implement 100 in the closed state or the open state. As shown in FIGS. 3A-3D, the inner member 120 further comprises one or more protrusions 125*a*, 125*b*, 125*c* configured to interface with corresponding tabs 115*a*, 115*b*, 115*c* of the outer member 110. As shown in FIG. 5, the flipper 115*a* of the outer member 110 can interface with at least one corresponding protrusion 125*c* of the inner member 120. The flipper 115*a* should be configured and sized so it can bend past the corresponding protrusion 125*c* of the inner member 120 thereby preventing or substantially reducing the rotation of the outer member 110 beyond a predetermined point relative to the inner member 120. In this manner, the outer member 110 may be locked into place relative to the inner member 120 and prevent the oral care implement 100 from being inadvertently placed in the open position when the oral care implement 100 is not in use. While shown herein with the flipper 115*a* provided to the outer member 110, it should be appreciated that the flipper could also be provided to the inner member 120 (in addition to or instead of one on outer member 110) and interface with one or more the tabs 115*a*, 115*b*, 115*c* of the outer member 110 in the same or similar manner as the flipper 115*a* of the outer member interfaces with the protrusions 125*a*, 125*b*, 125*c* of the inner member 120.

The inner member 120 can also comprise one or more indicators 126 to signal when the oral care implement 100 is in a closed state, an open state, or in between the closed state and the open state. For example, as shown in FIG. 1A, FIG. 1B, FIG. 3A and FIG. 3B, the outer surface of the inner member 120 can include linear scale as an indicator 126 that is used in connection with one or more corresponding indicators 116 of the outer member 110 to provide a visual indication of the state of the oral care implement 100.

The inner member 120 may be constructed from any sufficiently durable and resilient material. Examples of a suitable materials for the inner member 120 include a variety of plastics and resins, such as, for example, polypropylene and polyethylene.

In certain aspects, a sealing element may be positioned at or within the base 113 of the inner member 120 to create a seal to prevent or reduce drying of the oral care fluid, for example, by the ambient environment. An example of a suitable sealing element is an o-ring. The sealing element may be constructed from any suitable material such as ethylene propylene rubber (EPDM). An example of a suitable sealing element is an o-ring available from McMaster-Carr® having an address of 600 N County Line Rd., Elmhurst, IL 60126-2034.

A3. Cleaning Element

The cleaning element 130 extends from the head 111. For example and as shown in FIG. 1A, the cleaning element 130 may comprise a plurality of teeth cleaning elements placed in and extending from corresponding recesses 117 of the outer surface of the head 111. The teeth cleaning elements may be arranged in a circular cross-section shape or any other desired shape, including without limitation straight portions or sinusoidal portions. FIG. 1A shows the teeth cleaning elements positioned generally perpendicular to the outer surface of head 111. But, it should be understood that the teeth cleaning elements may be positioned at various angles with respect to the outer surface of head 111 as desired. In this manner, it is possible to select many different configurations, materials and orientations to achieve specific intended results, for example, enhanced cleaning, tooth polishing, breath freshening, tooth whitening, massaging of the gums, and any combination of two or more of the foregoing.

The teeth cleaning elements may be constructed from any sufficiently flexible and resilient material to enable the desired effect during use of the oral care implement 100. Examples of suitable materials for the teeth cleaning elements include without limitation nylon, polyethylene, and the like.

A4. Adapter

It should be appreciated that a reservoir containing oral care fluid (e.g., a tube of toothpaste) can have a variety of different physical configurations that can vary depending on the manufacturer. For example, the reservoir may have a connection type that varies from one manufacturer to another manufacturer. Thus, in certain aspects, the oral care implement 100 can optionally also include one or more adapters 140 configured to permit a connection with a variety of different reservoirs to enable placement of the oral care implement 100 in fluid communication with such reservoirs.

Figure 4A:
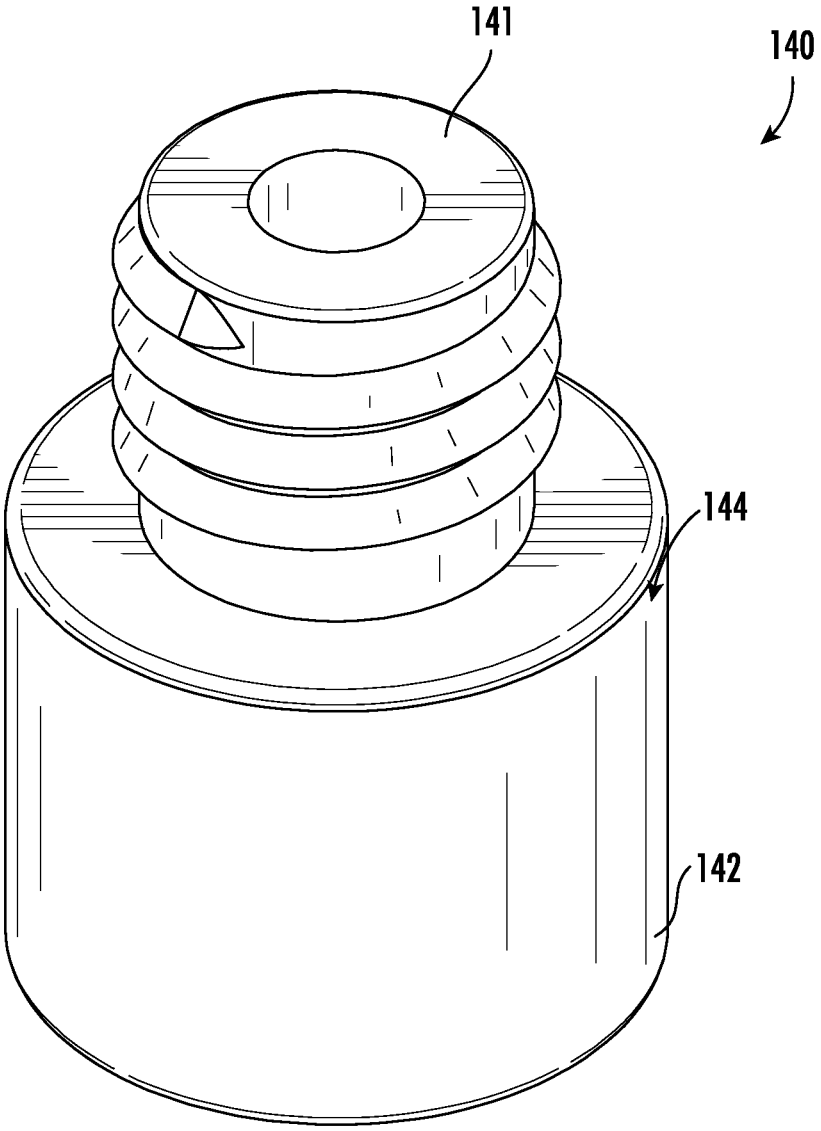
FIG. 4A illustrates a perspective view of the adapter of the oral care implement show in in FIG. 1A.
Figure 4B:
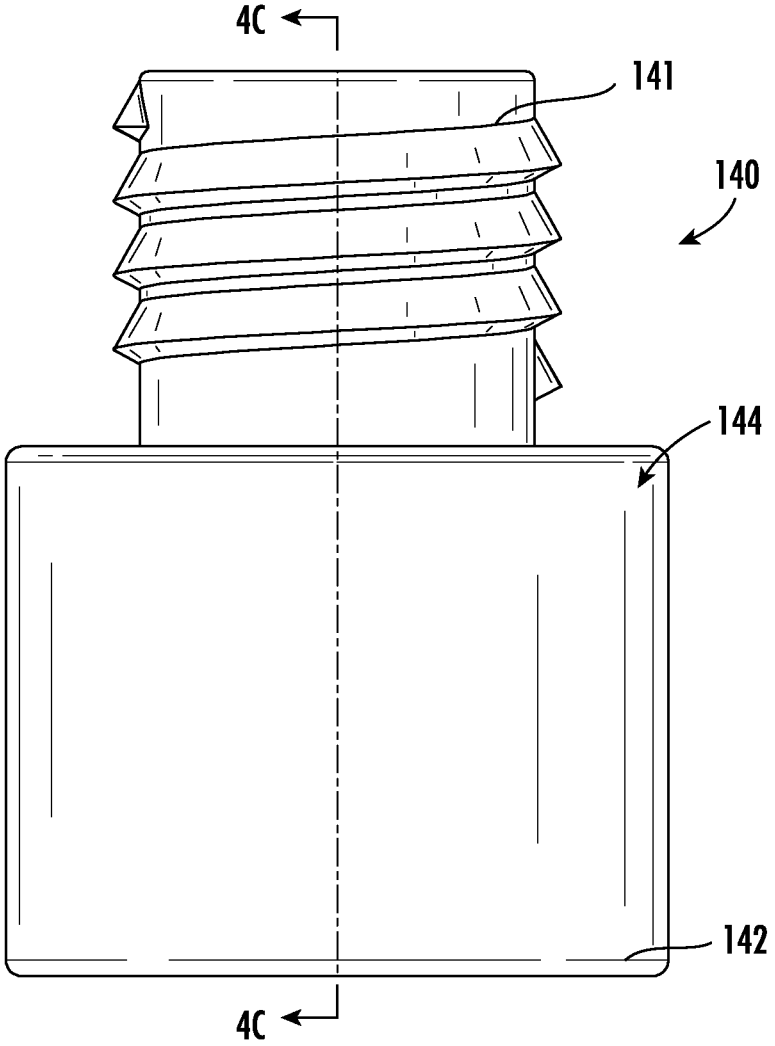
FIG. 4B illustrates a view of the adapter shown in FIG. 4A.
Figure 4C:
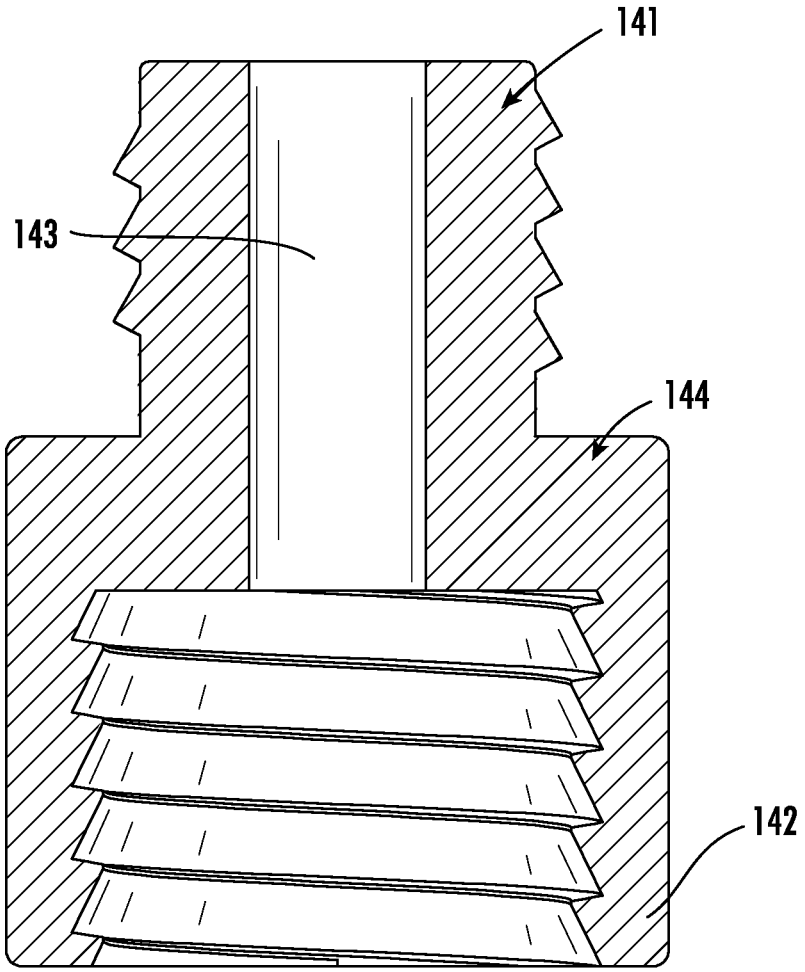
FIG. 4C illustrates a cross-sectional view of the adapter shown in FIG. 4B.

For example, as shown in FIGS. 4A-4C, the adapter 140 comprises a base 144 and defines a tunnel 143 extending therethrough so as to permit flow of the oral care fluid from the reservoir through the adapter 140 to the inner member 120. The adapter 140 comprises a first connection at the first end portion 141 (e.g., male threaded connection) that is configured to interface with the inner member 120 to secure the inner member 120 to the adapter 140, and a second connection at the second end portion 142 (e.g., female threaded connection) that is configured to interface with the reservoir to secure the adapter 140 to the reservoir. Examples of suitable connections include without limitation threaded connections. It should be appreciated that the adapter 140 may be constructed from any sufficiently durable and resilient material. Examples of a suitable materials for the adapter 140 include a variety of plastics and resins, such as polypropylene, polyethylene, and so forth.

In certain aspects, the adapter 140 may further comprise a sealing element positioned within the adapter 140 so as to create a seal prevent or reduce drying of the oral care fluid, for example, by the ambient environment. An example of a suitable sealing element is an o-ring. The sealing element may be constructed from any suitable material such as ethylene propylene rubber (EPDM). An example of a suitable sealing element is an o-ring available from McMaster-Carr® having an address of 600 N County Line Rd., Elmhurst, IL 60126-2034.

B. Methods

One or more methods are also provided for placing an oral care implement 100 into the open state, closed state, or in between the open state and the closed state. In an aspect the method comprises rotating at least a portion of the elongated inner member 120 within at least a portion of an elongated outer member 110 so as to control the flow of oral care fluid from a reservoir through the oral care implement 100.

To place the oral care implement 100 in the closed state, the inner member 120 is rotated relative to the outer member 110. The flipper 115*a* of the outer member 110 bends past at least one of the protrusions 125*a*, 125*b*, 125*c* of the inner member 120 thereby locking the oral care implement 100 into the closed state. In the closed state, the aperture 122 formed by the first end portion 121 of the elongated inner member 120 is not in fluid communication with the opening 112 formed by the head 111 of the elongated outer member 110 thereby preventing the flow of the oral care fluid through the oral care implement 100.

To place the oral care implement 100 in the open state, the inner member 120 is rotated relative to the outer member 110. The flipper 115*a* of the outer member 110 bends beyond at least one of the protrusions 125*a*, 125*b*, 125*c* of the inner member 120 thereby unlocking the oral care implement 100 and allowing rotation to place the oral care implement 100 in the open state.

In an aspect, when the oral care implement 100 is placed into the open state from the closed state, the outer member 110 is rotated or turned about 90 degrees relative to the inner member 120, thereby placing the aperture 122 in fluid communication with the opening 112 to permit the flow of the oral care fluid through the oral care implement 100. Similarly, when the oral care implement 100 is placed into the closed state from the open state, the outer member 110 is rotated or turned about 90 degrees relative to the inner member 120, thereby removing the aperture 122 from being in fluid communication with the opening 112 to prohibit or reduce the flow of the oral care fluid through the oral care implement 100.

As shown in FIG. 5, the protrusions 125*a*, 125*b*, 125*c* of the inner member 120 interface with the tabs 115*a*, 115*b*, 115*c* on the outer member 110 to prohibit the outer member 110 from being rotated beyond a predetermined point. For example, in an aspect, the protrusions 125*a*, 125*b*, 125*c* and tabs 115*a*, 115*b*, 115*c* are configured to preclude the outer member 110 from being rotated beyond a predetermined point (e.g., 180 degrees or more relative to the inner member 120), which prevents the oral care implement 100 from being inadvertently placed into the closed position.

In the open state, the aperture 122 is in fluid communication with the opening 112 thereby permitting the flow of the oral care fluid from the reservoir through the oral care implement 100. The oral care fluid can flow through a path comprising the channel of the inner member 120 in fluid communication with the opening 112 defined by a head 111 of the elongated outer member 110. The path should sized and configured so a user does not have to apply excessive pressure to cause the oral care fluid to flow through the oral care implement 100. For example, in an aspect, the path may be sized and configured so that when an external pressure is applied to the reservoir of in the range of about 1.4 psig to about 3.8 psig, the oral care fluid flows through the path at a flow rate in the range of about 0.0065 $in^3$/sec to about 0.0102 $in^3$/sec. The path may sized and configured so that when an external pressure is applied to the reservoir of at least about 2.5 psig, the oral care fluid flows through the path at a flow rate of at least about 0.008 $in^3$/sec.

The subject matter is described above with reference to numerous aspects and specific examples. Many variations will suggest themselves to those skilled in the art in light of the above detailed description. All such obvious variations are within the full intended scope of the appended claims. Other aspects of the subject matter disclosed herein can include, but are not limited to, the following (aspects are described as "comprising" but, alternatively, can "consist essentially of", or "consist of"):

Aspect 1. An oral care implement comprising (A) an elongated outer member comprising a head defining at least one opening, a base, and at least one cavity formed by the outer member and extending from the head to the base; (B) an elongated inner member comprising a first end portion defining an aperture configured for placing in fluid communication with the opening of the head, a second end portion and at least one channel formed by the inner member and extending from the first end portion to the second end portion; and (C) a cleaning element extending from the head; wherein at least a portion of the elongated inner member is sized and configured to be positioned within at least a portion of the elongated outer member; wherein at least a portion of the elongated inner member is rotatable within at least a portion of the elongated outer member from a closed state to an open state and from an open state to a closed state so as to control the flow of an oral care fluid through the oral care implement; and wherein the oral care implement is configured for placing in fluid communication with a reservoir containing the oral care fluid.

Aspect 2. An oral care implement as defined by Aspect 1, wherein in the closed state the aperture is not in fluid communication with the opening thereby preventing the flow of the oral care fluid through the oral care implement.

Aspect 3. An oral care implement as defined by any of Aspects 1-2, wherein in the open state the aperture is in fluid communication with the opening thereby permitting the flow of the oral care fluid through the oral care implement.

Aspect 4. An oral care implement as defined by any of Aspects 1-3, wherein the base of the elongated outer member interfaces with the second end portion of the elongated inner member to form a lock configured to place the oral care implement is in the closed state or the open state.

Aspect 5. An oral care implement as defined by any of Aspects 1-3, wherein the elongated inner member further comprises one or more protrusions configured to interface with one or more corresponding tabs of the elongated outer member to prevent rotation of the elongated outer member beyond a predetermined point relative to the elongated inner member.

Aspect 6. An oral care implement as defined by any of Aspects 1-5, wherein at least one flipper extends from the elongated outer member and is sized and configured to bend beyond at least one of the protrusions of the elongated inner member.

Aspect 7. An oral care implement as defined by any of Aspects 1-6, wherein the oral care implement further comprises at least one flipper sized and configured to bend beyond at least one of the tabs of the elongated outer member, at least one of the protrusions of the elongated outer member, or both.

Aspect 8. An oral care implement as defined by any of Aspects 1-7, wherein the portion of the elongated outer member defining the opening tapers at a cross-sectional angle extending along the length of the opening.

Aspect 9. An oral care implement as defined by any of Aspects 1-8, wherein the portion of the elongated outer member defining the opening is frustoconical.

Aspect 10. An oral care implement as defined by any of Aspects 1-9, wherein the oral care implement further comprises a sealing element positioned at or within the base of the elongated inner member so as to prevent or reduce drying of the oral care fluid.

Aspect 11. An oral care implement as defined by any of Aspects 1-10, wherein the oral care implement further comprises an adapter for placing in fluid communication with a reservoir containing an oral care fluid and a sealing element positioned within the adapter so as to prevent or reduce drying of the oral care fluid.

Aspect 12. An oral care implement as defined by any of Aspects 1-11, wherein the cleaning element comprises a plurality of teeth cleaning elements.

Aspect 13. An oral care implement as defined by any of Aspects 1-12, wherein the opening is sized and positioned so as to permit substantially even distribution of the oral care fluid on an outer surface of the head and the cleaning element.

Aspect 14. An oral care implement as defined by any of Aspects 1-13, wherein the oral care fluid flows through a path comprising at least one channel formed by the elongated inner member in fluid communication with at least one opening defined by a head of the elongated outer member.

Aspect 15. An oral care implement as defined by any of Aspects 1-14, wherein when an external pressure is applied to the reservoir in the range of 1.4 psig to about 3.8 psig, the oral care fluid flows through the path at a flow rate in the range of about 0.0065 $in^3$/sec to about 0.0102 $in^3$/sec.

Aspect 16. A method comprising rotating at least a portion of an elongated inner member of an oral care implement within at least a portion of an elongated outer member of the oral care implement so as to control the flow of an oral care fluid from a reservoir through the oral care implement; wherein in a closed state an aperture formed by a first end portion of the elongated inner member is not in fluid communication with an opening formed by a head of the elongated outer member thereby preventing the flow of the oral care fluid through the oral care implement; and wherein in an open state the aperture is in fluid communication with the opening thereby permitting the flow of the oral care fluid through the oral care implement.

Aspect 17. A method as defined by Aspect 16, wherein the oral care fluid flows through a path comprising at least one channel formed by the elongated inner member in fluid communication with at least one opening defined by a head of the elongated outer member.

Aspect 18. A method as defined by any of Aspects 16-17, wherein when an external pressure is applied to the reservoir in the range of 1.4 psig to about 3.8 psig, the oral care fluid flows through the path at a flow rate in the range of about 0.0065 $in^3$/sec to about 0.0102 $in^3$/sec.

Aspect 19. A method as defined by any of Aspects 16-18, wherein the elongated inner member further comprises one or more protrusions configured to interface with corresponding tabs extending from the elongated outer member to prevent rotation of the elongated outer member beyond a predetermined point relative to the elongated inner member.

Aspect 20. A method as defined by any of Aspects 16-19, wherein the oral care implement further comprises at least one flipper extending sized and configured to bend beyond at least one of the protrusions of the elongated inner member, at least one of the protrusions of the elongate outer member, or both.

What is claimed is:

1. An oral care implement comprising:

(A) an elongated outer member comprising a head defining at least one opening, a base, and at least one cavity formed by the outer member and extending from the head to the base;

(B) an elongated inner member comprising a first end portion defining an aperture configured for placing in fluid communication with the opening of the head, a second end portion and at least one channel formed by the inner member and extending from the first end portion to the second end portion; and (C) a cleaning element extending from the head;

wherein at least a portion of the elongated inner member is sized and configured to be positioned within at least a portion of the elongated outer member;

wherein at least a portion of the elongated inner member is rotatable within at least a portion of the elongated outer member from a closed state to an open state and from an open state to a closed state so as to control a flow of an oral care fluid through the oral care implement;

wherein the oral care implement is configured for placing in fluid communication with a reservoir containing the oral care fluid;

wherein the base of the elongated outer member interfaces with the second end portion of the elongated inner member to form a lock configured to place the oral care implement in the closed state or the open state;

wherein the elongated inner member further comprises one or more protrusions configured to interface with one or more corresponding tabs of the elongated outer member to prevent rotation of the elongated outer member beyond a predetermined point relative to the elongated inner member; and wherein at least one flipper extends from the elongated outer member and is sized and configured to bend beyond at least one of the protrusions of the elongated inner member.

2. The oral care implement according to claim 1, wherein in the closed state the aperture is not in fluid communication with the opening thereby preventing the flow of the oral care fluid through the oral care implement.

3. The oral care implement according to claim 1, wherein in the open state the aperture is in fluid communication with the opening thereby permitting the flow of the oral care fluid through the oral care implement.

4. The oral care implement according to claim 1, wherein the oral care implement further comprises at least one flipper sized and configured to bend beyond at least one of the tabs of the elongated outer member, at least one of the protrusions of the elongated inner member, or both.

5. The oral care implement according to claim 1, wherein the portion of the elongated outer member defining the opening tapers at a cross-sectional angle extending along the length of the opening.

6. The oral care implement according to claim 1, wherein the portion of the elongated outer member defining the opening is frustoconical.

7. The oral care implement according to claim 1, wherein the oral care implement further comprises a sealing element positioned at or within the base of the elongated inner member so as to prevent or reduce drying of the oral care fluid.

8. The oral care implement according to claim 1, wherein the oral care implement further comprises an adapter for placing in fluid communication with a reservoir containing an oral care fluid and a sealing element positioned within the adapter so as to prevent or reduce drying of the oral care fluid.

9. The oral care implement according to claim 1, wherein the cleaning element comprises a plurality of teeth cleaning elements.

10. The oral care implement according to claim 1, wherein the opening is sized and positioned so as to permit even distribution of the oral care fluid on an outer surface of the head and the cleaning element.

11. The oral care implement according to claim 10, wherein the oral care implement further comprises a path adapted for the oral care fluid to flow through, the path comprising the at least one channel formed by the elongated inner member in fluid communication with the at least one opening defined by the head of the elongated outer member.

12. The oral care implement according to claim 11, wherein when an external pressure is applied to the reservoir in the range of 1.4 psig to 3.8 psig, the oral care fluid flows through the path at a flow rate in the range of 0.0065 $in^3$/sec to 0.0102 $in^3$/sec.

13. A method comprising:

(A) rotating at least a portion of an elongated inner member of an oral care implement within at least a portion of an elongated outer member of the oral care implement so as to control the flow of an oral care fluid from a reservoir through the oral care implement;

wherein in a closed state an aperture formed by a first end portion of the elongated inner member is not in fluid communication with an opening formed by a head of the elongated outer member thereby preventing the flow of the oral care fluid through the oral care implement;

wherein in an open state the aperture is in fluid communication with the opening thereby permitting the flow of the oral care fluid through the oral care implement; and wherein the elongated inner member further comprises one or more protrusions configured to interface with corresponding tabs extending from the elongated outer member to prevent rotation of the elongated outer member beyond a predetermined point relative to the elongated inner member; and wherein the oral care implement further comprises at least one flipper sized and configured to bend beyond at least one of the protrusions of the elongated inner member, at least one of the tabs of the elongate outer member, or both.

14. The method according to claim 13, wherein the oral care fluid flows through a path comprising at least one channel formed by the elongated inner member in fluid communication with the at least one opening defined by the head of the elongated outer member.

15. The method according to claim 14, wherein when an external pressure is applied to the reservoir in the range of 1.4 psig to 3.8 psig, the oral care fluid flows through the path at a flow rate in the range of 0.0065 $in^3$/sec to 0.0102 $in^3$/sec.

* * * * *